US006118955A

United States Patent [19]

Yoneda et al.

[11] Patent Number: 6,118,955

[45] Date of Patent: Sep. 12, 2000

[54] IMAGE FORMING APPARATUS AND FIXING APPARATUS

[75] Inventors: Satoru Yoneda, Toyohashi; Hideji Hayashi, Okazaki; Toshio Sakata, Toyohashi; Takashi Yamada, Aichi-Ken; Yoshifumi Kosagi, Toyokawa; Tetsuya Yamada, Aichi-Ken, all of Japan

[73] Assignee: Minolta Co., Ltd., Osaka, Japan

[21] Appl. No.: 09/179,940

[22] Filed: Oct. 28, 1998

[30] Foreign Application Priority Data

Oct. 29, 1997 [JP] Japan ..... 9-297170
Sep. 24, 1998 [JP] Japan ..... 10-270034

[51] Int. Cl.[7] ..... G03G 15/20

[52] U.S. Cl. ..... 399/69; 399/329; 219/216; 432/60

[58] Field of Search ..... 399/69, 328, 330–332, 399/329; 219/216; 432/60

[56] References Cited

U.S. PATENT DOCUMENTS 4,780,742 10/1988 Takahashi et al. ..... 219/216 X
5,250,998 10/1993 Ueda et al. ..... 399/329
5,714,736 2/1998 Yoneda et al. ..... 219/216
5,778,294 7/1998 Hiraoka et al. ..... 399/329
5,784,678 7/1998 Matsuura et al. ..... 399/329
5,847,361 12/1998 Yonekawa et al. ..... 219/216
5,857,136 1/1999 Yoneda et al. ..... 399/329
5,873,020 2/1999 Matsuura et al. ..... 399/329

FOREIGN PATENT DOCUMENTS 4-365079 12/1992 Japan .
5-72925 3/1993 Japan .
06318001 11/1994 Japan .
09138599 5/1997 Japan .

*Primary Examiner*—Richard Moses
*Attorney, Agent, or Firm*—McDermott, Will & Emery

[57] ABSTRACT

In a belt type fixing apparatus having a heat roller temperature sensor that detects the temperature of a heat roller that contains a heater for heating a fixing belt, and a fixing belt temperature sensor that is set to contact a pressure roller and indirectly detects the temperature of the fixing belt, the heater that heats the fixing belt is controlled in such a way that the temperature detected by the heat roller temperature sensor matches the target temperature of the heat roller that is set based on the temperature detected by the fixing belt temperature sensor.

16 Claims, 10 Drawing Sheets

IMAGE FORMING APPARATUS AND FIXING APPARATUS

BACKGROUND OF THE INVENTION

1. Field of the Invention

The present invention relates to an image forming apparatus such as electrophotographic copying machines, printers and facsimile machines, and a fixing apparatus provided in the image forming apparatus.

2. Description of the Related Art

The thermal roller type fixing apparatus has been widely used for image forming apparatuses such as electrophotographic copying machines, printers and facsimile machines. The thermal roller type fixing apparatus comprises a heat roller and a pressure roller that is held in contact with the heat roller under pressure, wherein a recording medium (hereinafter called "sheet") such as recording papers and OHP sheets, carrying unfixed toner image passes through a contact area, or a nip area between the heat roller and the pressure roller, thus causing the toner image to be fixed on the sheet.

Under the pressure of increasing demands for quick printing and low power consumption in recent years, a fixing belt type fixing apparatus was proposed as disclosed in JP-A-06-318001.

This kind of fixing apparatus has a heat source placed at a distance from the nip area and uses a low heat capacity fixing belt in order to shorten the time needed for raising the temperature. It results in a severe temperature drop in the part of the fixing belt which comes in contact with the sheet at the nip area.

Consequently, a fixing apparatus disclosed in the JP-A-09-138599 has a pair of rollers that supports and rotates the fixing belt, wherein one of rollers is equipped with a heat source, while the other of rollers contacts the pressure roller under pressure across the fixing belt to constitute the nip area. The fixing apparatus further has two temperature sensors, one on the roller equipped with the heat source and the other on the pressure roller with no heat source that directly contacts the nip area, wherein the two temperature sensors provide temperature data for temperature control.

A problem, however, is a complexity in temperature control based on the temperatures of the roller equipped with the heat source and the pressure roller that is contacting the fixing belt and constituting the nip area, which are measured by the sensors, respectively.

SUMMARY OF THE INVENTION

The purpose of the invention is to provide a fixing apparatus equipped with a fixing belt that is capable of controlling temperatures in a simple and accurate manner, and an image forming apparatus equipped with the fixing apparatus.

Another purpose of the invention is to provide a fixing apparatus equipped with a fixing belt that is capable of controlling the fixing belt temperature at the nip area to a temperature suitable for fixing with a simple control system.

One aspect of the present invention is a fixing apparatus comprising: a plurality of rollers; a belt supported by the rollers; a heat source for heating the belt; a roller temperature sensor that detects a temperature of one of the rollers; a belt temperature sensor that detects a temperature of the belt; and a controller that determines a target temperature for the roller based on the temperature detected by the belt temperature sensor, and controls heat generated by the heating source based on the set target temperature and the temperature detected by the roller temperature sensor.

Another aspect of the present invention is an image forming apparatus comprising: an image forming device for forming an unfixed image on a recording medium; and a fixing apparatus including a plurality of rollers, a belt supported by the rollers, a heat source for heating the belt, a roller temperature sensor that detects a temperature of one of the rollers, a belt temperature sensor that detects a temperature of the belt, a controller that determines a target temperature for the roller based on the temperature detected by the belt temperature sensor, controls heat generated by the heating source based on the set target temperature and the temperature detected by the roller temperature sensor, and controls a timing for forming the unfixed image on the recording medium by means of the image forming device based on the temperature detected by the belt temperature sensor, and a transport mechanism for transporting, toward a fixing area of the belt, the recording medium holding the unfixed image formed by the image forming device.

Another aspect of the present invention is a fixing apparatus comprising: a plurality of rollers that rotate in a fixed direction; a belt that is supported by the rollers and causes an unfixed image on a recording medium to be fixed at a fixing area; a heating source that heats the belt; a belt temperature sensor that detects a temperature of the belt on a downstream side of the fixing area relative to a rotating/moving direction of the belt; and a controller that controls the heating source based on the temperature detected by the belt temperature sensor.

Another aspect of the present invention is a fixing apparatus comprising: a plurality of rollers that rotate in a fixed direction; a belt that is supported by the rollers and causes an unfixed image on a recording medium to be fixed at a fixing area; a heating source that heats the belt; a tension roller that contacts the belt on a downstream side of the fixing area; a tension roller temperature sensor that detects a temperature of the tension roller; and a controller that controls the heating source based on the temperature detected by the tension roller temperature sensor.

The objects, features, and characteristics of this invention other than those set forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

Embodiment 1

Figure 1:
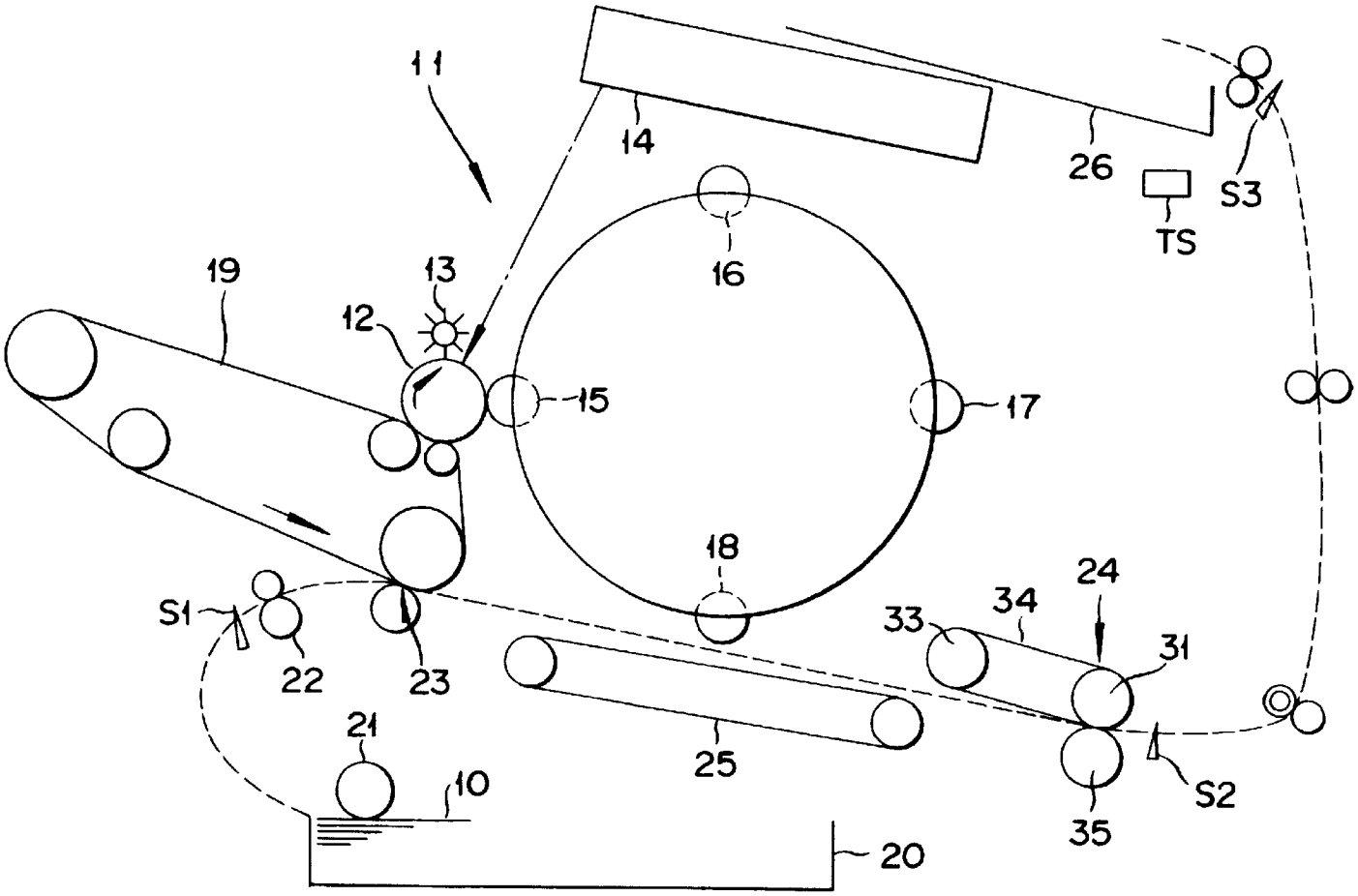
FIG. 1 is a schematic section view of a printer of a first embodiment according to the present invention.

FIG. 1 is a schematic section view of an electrophotographic type color printer of a first embodiment according to the present invention.

A printer 11 shown in FIG. 1 comprises a photoconductor drum 12, which functions as an image carrier, and a laser generator 14. The photoconductor drum 12 that rotates in the direction indicated by the arrow is surrounded by an electrostatic charger 13 that charges the outer periphery of the photoconductor drum 12, a developing device equipped with the first through fourth developing units 15, 16, 17, and 18, a transfer belt 19, a cleaning device (not shown) that removes remaining toner on the photoconductor drum 12, and an internal temperature sensor TS that detects the internal temperature of the printer 11.

The laser generator 14 generates and modulates laser beams depending on the level of the image signal sent from equipment such as a computer (not shown). The laser beams pass through a polygon mirror, an f-θ lens, a reversing mirror, etc., which are not shown in the figure, to irradiate the photoconductor drum 12 between the electrostatic charger 13 and the developing device.

An electrostatic latent image formed on the photoconductor drum 12 in response to the laser beams becomes an apparent image as a yellow toner image by means of the first developing unit 15. The yellow image thus formed is then held on the transfer belt 19 that moves in a rotating manner in the direction indicated by the arrow. The following electrostatic latent image formed on the photoconductor drum 12 becomes apparent as a magenta toner image by means of the second developing unit 16. This magenta image is overlaid on the yellow toner image on the transfer belt 19. Similarly, the succeeding electrostatic latent image formed on the photoconductor drum 12 becomes apparent as a cyan toner image by means of the third developing unit 17. By overlaying this cyan toner image on the existing image on the transfer belt 19, a full-color image will be generated. The fourth developing unit 18 holds a black toner. When a monochromatic print is designated, the electrostatic latent image on the photoconductor drum 12 becomes an apparent image by the fourth developing unit 18.

A paper feed cassette 20 detachably attached to the printer main unit has a plurality of sheets of paper 10 in an accumulated condition. The sheets 10 are fed one sheet at a time with a help of a paper feed roller 21 and transported by means of a timing roller 22 timed with the toner formation to a transfer zone 23. The full-color toner image on the transfer belt 19 is transferred to the sheet 10 in this transfer zone 23. As a result, the unfixed toner image is formed on the sheet 10. After the transfer, the sheet 10 is separated from the transfer belt 19 and transported toward a fixing apparatus 24 by means of a transporting belt 25. The unfixed toner transferred to the sheet 10 is fused and fixed at the fixing apparatus 24. The sheet 10 on which the toner is fixed is discharged to a discharge tray 26. This fixing apparatus 24 is a belt type apparatus, the constitution of which will be described later.

Once the transfer to the sheet 10 is completed, the remaining toner on the photoconductor drum 12 is removed by the cleaning device and removed of its remaining electrostatic charge by an electrostatic eraser. The photoconductor drum 12 is then recharged by the electrostatic charger 13, and on which a latent image is formed by laser beams and developed by the developing units 15 through 18.

Along the sheet transport path, a plurality of sensors S1, S2 and S3 are arranged to detect the sheet 10. These sensors S1, S2 and S3 provide signals as they detect the leading edge and/or the trailing edge of the sheet 10 to provide control timing for members disposed inside the printer.

Movable members such as those included in the transfer path, such as a transport belt 25 and a timing roller 22, those included in the image forming system, such as a transfer belt 19 and a photoconductor drum 12, and those included in the fixing apparatus such as the driving roller are all driven by a power transmitting mechanism comprising gears, pulleys and the fixing belt (all of which are not shown) as well as an electric motor (not shown), which is the source of driving power. The transfer speed of the sheet in each part is synchronized with the rotation or transfer speed of each member.

In the description herein, the above apparatus-constituting members that relates to the forming of unfixed image on the sheet other than the fixing apparatus shall be called the image forming system.

Figure 2:
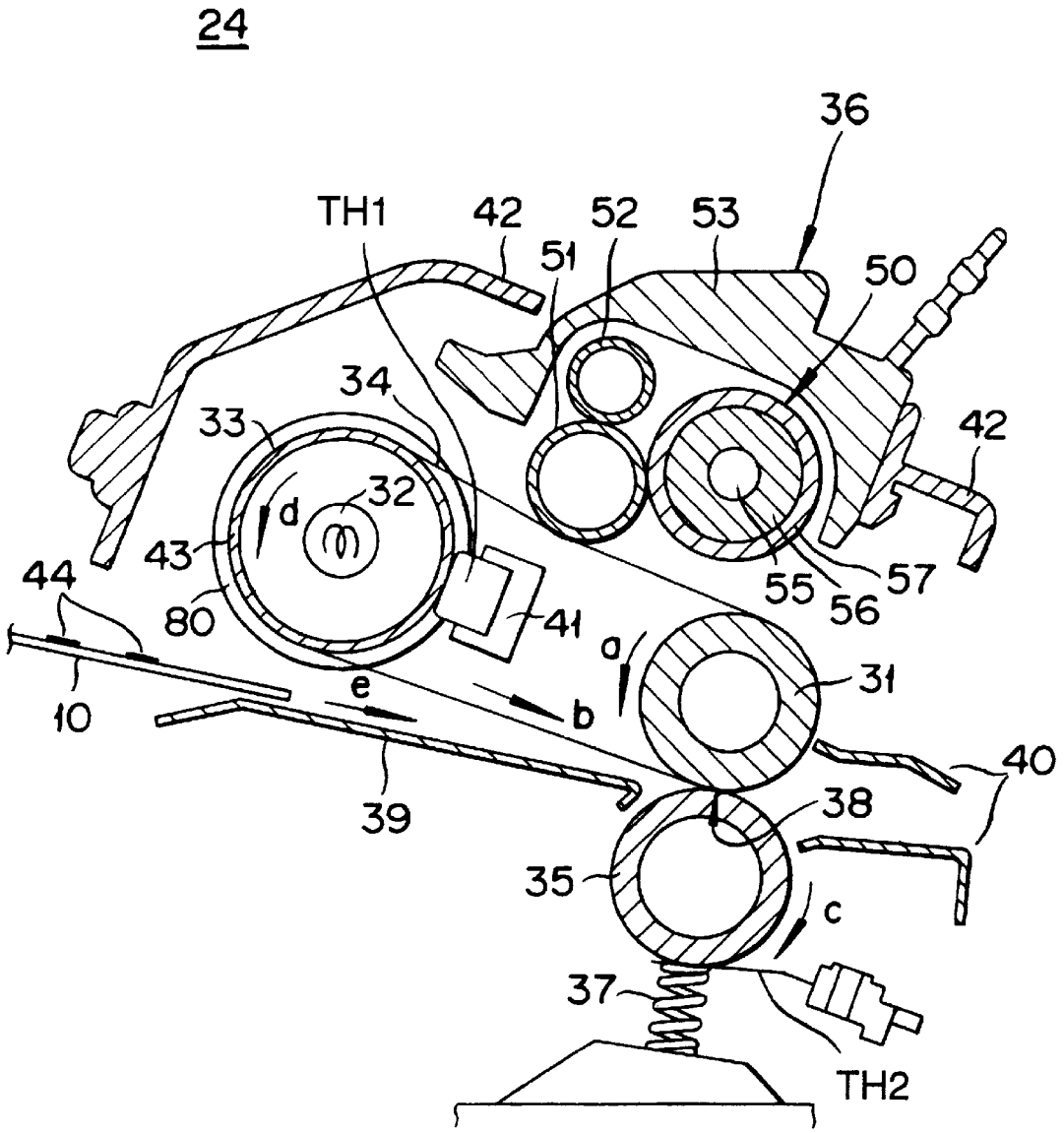
FIG. 2 is a cross section of a fixing apparatus used in the printer.

FIG. 2 is the cross section of the belt type fixing apparatus shown in FIG. 1.

The fixing apparatus 24 comprises: a driving roller 31 that is arranged to be able to rotate in the direction indicated by the arrow "a"; a heat roller 33 that has a halogen heater lamp 32, a heat source, enclosed therein; a fixing belt 34 that runs between the driving roller 31 and the heat roller 33; a pressure roller 35 that applies pressure to the driving roller 31 via the fixing belt 34; and an oil coating device (releasing agent supplying device) 36 that coats (supplies) a releasing agent on the outer periphery of the fixing belt 34 in order to prevent the offset phenomenon. The releasing agent used here is silicone oil.

At least one of the rollers 31 and 33 between which the fixing belt 34 runs (the heat roller 33 in the example depicted in the figure), is equipped at both ends as to the axial direction with an edge regulator 80 that prevents the fixing belt 34 from making slant or snaking motions when the belt is running in order to stabilize the running of the fixing belt 34.

The fixing belt 34 has a thin thickness and is preferably a seamless belt. The fixing belt 34 shown in FIG. 2 is an endless belt comprising: a belt base consisting of either carbon steel, stainless steel, nickel or heat-resistant resin; and a rubber layer with good heat-resisting properties and release properties against the toner formed by coating the outer surface of the belt base with silicon rubber having a good affinity with silicone oil. The thickness of the belt base is approximately 40 $\mu$m. The thickness of the rubber coating is approximately 200 $\mu$m. The rubber layer of the fixing belt 34 can be formed with tetrafluoroethylene resin.

The drive roller 31 has a drive gear (not shown) affixed to one end thereof, the drive gear being driven by a drive source (not shown) such as an electric motor in the direction indicated by the arrow "a." The drive roller 31 comes in contact with the back side of the fixing belt 34 to drive the fixing belt 34 toward the direction indicated by the arrow "b." In order to move the fixing belt 34 securely, the outer periphery of the drive roller 31 is covered by a material with a high friction coefficient such as silicon rubber so that it does not slip relative to the fixing belt 34. Moreover, in order to secure a prescribed nipping width, the material that covers the outer periphery of the drive roller 31 is preferably a material with a relatively small hardness, for example, silicon sponge. The motor of the drive roller 31 is the source of the driving power for other rotating members and transfer members of the printer as mentioned before. Therefore, as the motor speed changes, the speed of the driving roller 31 changes in synchronization with all of these members.

The heat roller 33 is a hollow metal roller having the lamp 32 installed on the axis thereof. The heat source of the lamp 32 is a resistance heating element or an electromagnetic induction heating device. Also, from the standpoint of providing heat effectively to the fixing belt 34, the heat roller 33 is preferably made of a material with a high thermal conductivity, such as aluminum or copper.

The pressure roller 35 is a roller made of a metal pipe, the outer periphery of which is covered with silicon rubber or fluorocarbon resin, and is urged by the force of a spring 37 to press against the drive roller 31 via the fixing belt 34. As the fixing belt 34 moves in the direction indicated by the arrow "b" in correspondence with the rotation of the drive roller 31, the pressure roller 35 is driven in the direction indicated by the arrow "c" due to its friction with the fixing belt 34. The outer surface hardness of the drive roller 31 and that of the pressure roller 35 are set to hold a relation: "outer surface hardness of the pressure roller 35 ≧outer surface hardness of the drive roller 31." The reason for this setting is as follows. In order to smoothly discharge the sheet 10 after the toner is fixed from the nip area 38 between the pressure roller 35 and the fixing belt 34, it is necessary to send the sheet 10 in the direction tangentially from the surface of the drive roller 31, i.e., flatly. This can be achieved if the pressure roller 35 sinks into the drive roller 31 slightly via the fixing belt 34.

In order to guide the sheet 10 holding the unfixed toner without it touching the fixing belt 34 to the nip area 38, a guide plate 39 is provided under the fixing belt 34. Also, a paper discharge guide 40 is provided in the downstream of the nip area 38.

A temperature sensor TH1 is provided inside of the fixing belt 34 to detect the temperature of the heat roller 33. A temperature sensor TH2 is provided in contact with the pressure roller 35 that is contacting the fixing belt 34 and constituting the nip area 38 in order to detect the temperature of the pressure roller 35. The temperature of the fixing belt 34 is detected based on the temperature of the pressure roller 35 that is measured by the temperature sensor TH2. Therefore, the temperature sensor TH2 is also called the fixing belt temperature sensor. In other words, by measuring the temperature of the pressure roller 35, the temperature of the fixing belt 34 at the nip area 38, which is the contact point between the fixing belt 34 and the pressure roller 35, is detected.

The heat roller temperature sensor TH1 and the fixing belt temperature sensor TH2 are consisting of, for example, thermistors and contact the heat roller 33 and the pressure roller 35 respectively to detect their surface temperatures. The heat roller temperature sensor TH1 is supported by a support 41 positioned relative to the rotating axis of the heat roller 33 to maintain a contacting condition, or a fixed position relative to the rotating axis of the heat roller 33.

As an alternative configuration, the heat roller temperature sensor TH1 can be provided to contact the outer surface of the fixing belt 34 where the heat roller 33 is contacting. Under such a configuration, the temperature of the outer surface of the fixing belt 34 that directly contacts the toner is directly measured, so that a more accurate temperature control is possible. However, when the heat roller temperature sensor TH1 is configured to contact the outer surface of the fixing belt 34 directly, the contact position of the heat roller temperature sensor TH1 happens to be on the downstream side of the oil transfer roller 51 and the upstream side of the nip area 38. Therefore, as the heat roller temperature sensor TH1 contacts the surface of the fixing belt 34 after the surface of the fixing belt 34 is coated with oil by the oil transfer roller 51, the heat roller temperature sensor TH1 may end up scraping the oil on the surface of the fixing belt 34, disturb the oil on the surface of the fixing belt 34, or cause oil streaks. Such oil disturbances and oil streaks generated on the fixing belt 34 enter the nip area 38 without being corrected, and cause image noises and deterioration of the image quality.

In the present embodiment, the heat roller temperature sensor TH1 is configured in such a way that it contacts the heat roller 33. Because of this configuration, the outer periphery of the heat roller 33 is covered with a material having a low friction coefficient such as fluorocarbon resin. There is an additional advantage in placing the heat roller temperature sensor TH1 inside the fixing belt 34 in that it is not affected by the air stream generated around the fixing belt 34.

The oil coating device 36 is placed above the fixing belt 34 and comprises: an oil coating roller 50 that holds the oil to be coated on the fixing belt 34; an oil transfer roller 51 that abuts against the outer surface of the oil coating roller 50 and coats the oil supplied by the oil coating roller 50 on the outer surface of the fixing belt 34; a cleaning roller 52 that abuts against the outer surface of the oil transfer roller 51 to remove paper powder and the toner adhering on the oil transfer roller 51; and a holder 53 that supports these roller 50, 51, and 52 in such a manner as to let them rotate freely.

The oil transfer roller 51 functions as a tension roller providing an appropriate tension to the fixing belt 34 by pressuring the fixing belt 34 in the area where the fixing belt 34 moves from the drive roller 31 to the heat roller 33. This stabilizes the running of the fixing belt 34 as well as the oil coating action of the oil transfer roller 51 onto the fixing belt 34.

The oil coating roller 50 has a double layer construction consisting of an inner oil holding layer 56 surrounding a core bar 55, and a surface oil holding layer 57 provided on the inner oil holding layer 56. The oil transfer roller 51 is constituted of a silicon rubber having a good affinity with the silicone oil covering a core bar. The cleaning roller 52 comprises a core bar and a material that has a high affinity to the toner compared to silicon rubber such as felt covering the core bar. The surface roughness of the outer surface of the oil transfer roller 51 is chosen to be rougher than that of the outer surface of the fixing belt 34 in order to attract soil from the fixing belt 34. The surface roughness of the outer surface of the cleaning roller 52 is chosen to be larger than the surface roughness of the oil transfer roller 51 in order to attract soil from the oil transfer roller 51.

The oil coating device 36 is constituted in such a way as to be detachable from the frame 42 of the fixing device 24. When the oil held inside the oil coating roller 50 is used up, the oil coating device 36 is removed and replaced with a new oil coating device 36 to be attached to the frame 42. A cleaning pad, instead of cleaning roller 52, can be used to contact and clean the outer surface of the oil transfer roller 51. The oil coating roller 50 may be pressed against the fixing belt 34 directly.

The outline of the operation of the fixing device 24 is as follows.

When the motor is activated, the drive roller 31 rotates in the direction indicated by the arrow "a" and the fixing belt 34 runs in the direction indicated by the arrow "b." As the fixing belt 34 runs, the heat roller 33 is driven in the direction indicated by the arrow "d", and the pressure roller 35 is driven in the direction indicated by the arrow "c." The fixing belt 34 gets coated with the oil as it runs on the up-stream side of the heat roller 33 and heated to a prescribed temperature by the heat from the lamp 32 at the region (heating region 43) in contact with the heat roller 33, moving above the guide plate 39 toward the nip area 38 on the pressure roller 35.

The sheet 10 that holds the unfixed toner 44 on the side contacting the fixing belt 34 is transported in the direction indicated by the arrow "e" toward the nip area 38 guided by the guide plate 39. At this time, the sheet 10 and the unfixed toner 44 are heated (preheated) by the heat from the fixing belt 34 separated by a prescribed distance. Due to this heating, the unfixed toner 44 on the sheet 10 becomes softened to an appropriate degree.

When the sheet 10 arrives at the nip area 38, it is directly heated by the fixing belt 34, pressed between the pressure roller 35 and the drive roller 31, and further transported while it is pinched at the nip area 38. Thus, the unfixed toner 44 on the sheet 10 is sufficiently heated to fuse and pressed to be fixed on the sheet 10.

Consequently, a portion of the fixing belt 34 stretching from one end to the nip area 38 (including the nip area 38) corresponding to the travel of the sheet 10 along the guide plate 39 located beneath the heat roller 33 functions as the fixing area.

The offset phenomenon, or the transfer of the toner to the fixing belt 34 during fixing operation is inhibited by the oil coated on the outer surface of the fixing belt 34.

The sheet 10 that has passed through the nip area 38, separates spontaneously from the fixing belt 34, and transported toward the paper discharge tray 26 (refer to FIG. 1). The fixing belt 34, having been removed of heat due to the contact with the sheet 10, is replenished with the heat from the lamp 32 under the temperature control.

Since the heating of the fixing belt 34 is done after coating with the oil, the temperature of the fixing belt 34 is stable and a good fixation can be expected. Also, since the oil transfer roller 51 applies a tension to the fixing belt 34, unevenness (wild motion of the fixing belt) in the running of the fixing belt 34 can be minimized. Consequently, together with the help of the edge regulator 80, it provides the fixing belt 34 a smooth and stable running motion, thus contributing to the prolonging of the fixing belt life.

Since the soiling of the fixing belt 34 due to paper dust, toner, etc., can be transferred to the cleaning roller 52 via the oil transfer roller 51, so that the transfer of the soil to the oil coating roller 50 can be reduced. This results in a more stable and uniform supply of the oil from the oil coating roller 50 to the oil transfer roller 51. This, in return, results in a more stable and uniform supply of the oil transfer roller 51 to the fixing belt 34. Thus, a high grade fixed images can be obtained while preventing the offset phenomenon and cleaning the fixing belt 34.

Figure 3:
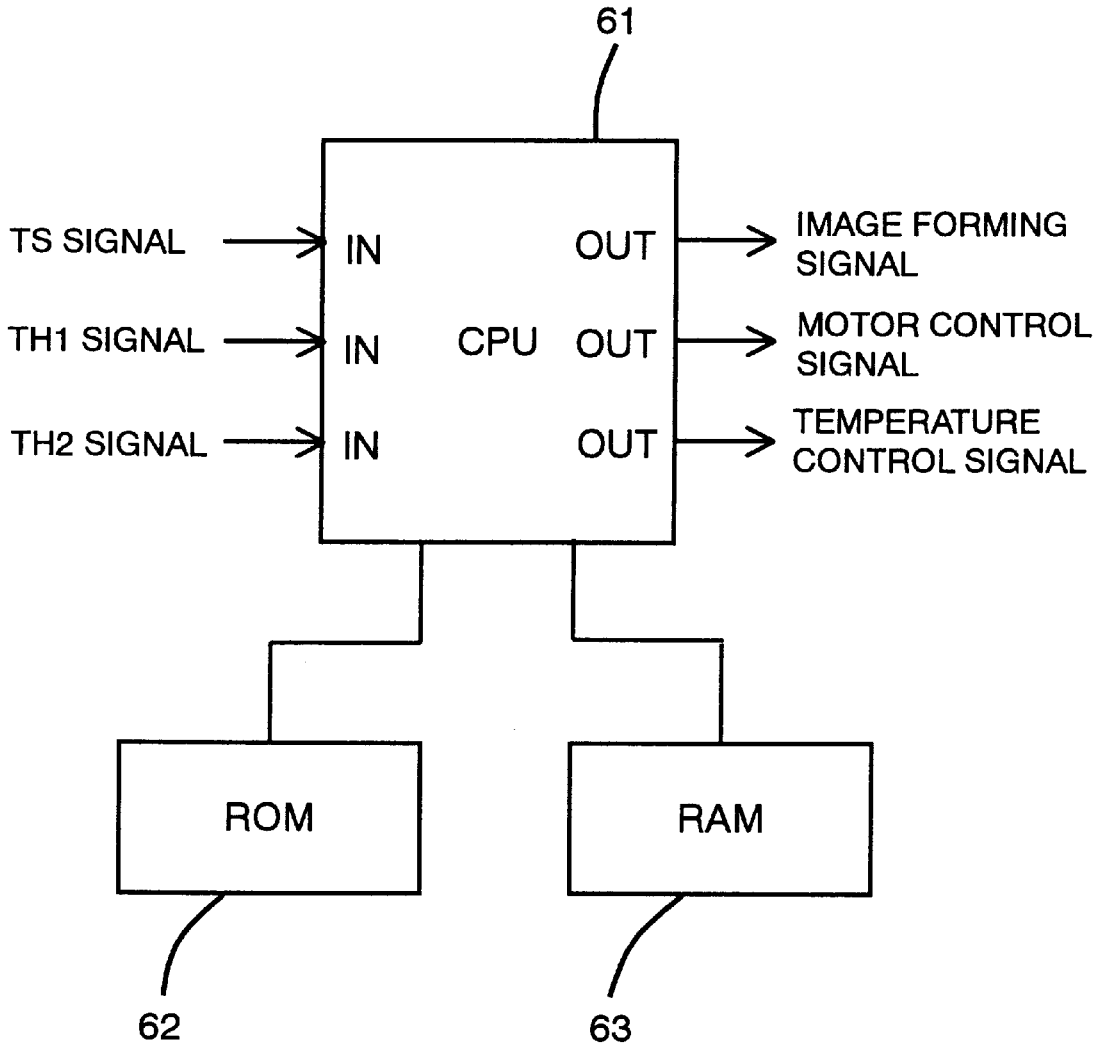
FIG. 3 is a block diagram showing constitution of a control unit of the printer.

FIG. 3 is a block diagram of a control unit that controls the entire printer. This control unit comprises a CPU61 that executes various controls, a ROM 62 that stores programs to be read and executed by the CPU61 for control, and a RAM 63 that stores data to be temporarily written and read by the CPU61 for operation, and controls functions of various parts of the printer, and temperatures and image forming timing of the fixing apparatus. The CPU61 receives signals from the internal temperature sensor TS, the heat roller temperature sensor TH1, and the fixing belt temperature sensor TH2. The CPU61, in return, sends control signals for the image forming system, motor control signals, and control signals for adjusting the heat generated by the lamp 32.

Next, let us describe the basic theory of the temperature control of the fixing apparatus.

In case of the roller type fixing apparatus, which has been very popular, the heat capacity of the heat roller is large so that the temperature drop due to the heat transfer from the heat roller to the pressure roller, the cleaning device and the releasing agent coating apparatus is small. As a result, the temperature control is relatively simple. For example, it is possible to maintain and approximately stabilize the heat roller temperature by the know hysteresis control regardless of varying conditions such the warm-up period, standby period, printing period, etc. In case of the belt type fixing apparatus, however, the belt has a low heat capacity. Therefore, the surface temperature of the fixing belt varies substantially, depending on whether the belt is rotating, stopped or printing. Also, when the temperature is controlled during the belt is stopped, the temperature of the part of the fixing belt, which is not in contact with the heat roller, gradually drops while the belt is stand still.

On the other hand, in order to achieve a high toner fixing performance for the entire length of a sheet that passes the nip area, it is desirable that the temperature of the fixing belt that passes the nip area remains constant from the arrival of the sheet until it is discharged. More specifically, it is necessary that the temperature of the fixing belt reaches a predetermined temperature and remains within the range suitable for fixing within the period from the receipt of the print signal until the arrival of the sheet at the nip area.

Figure 4:
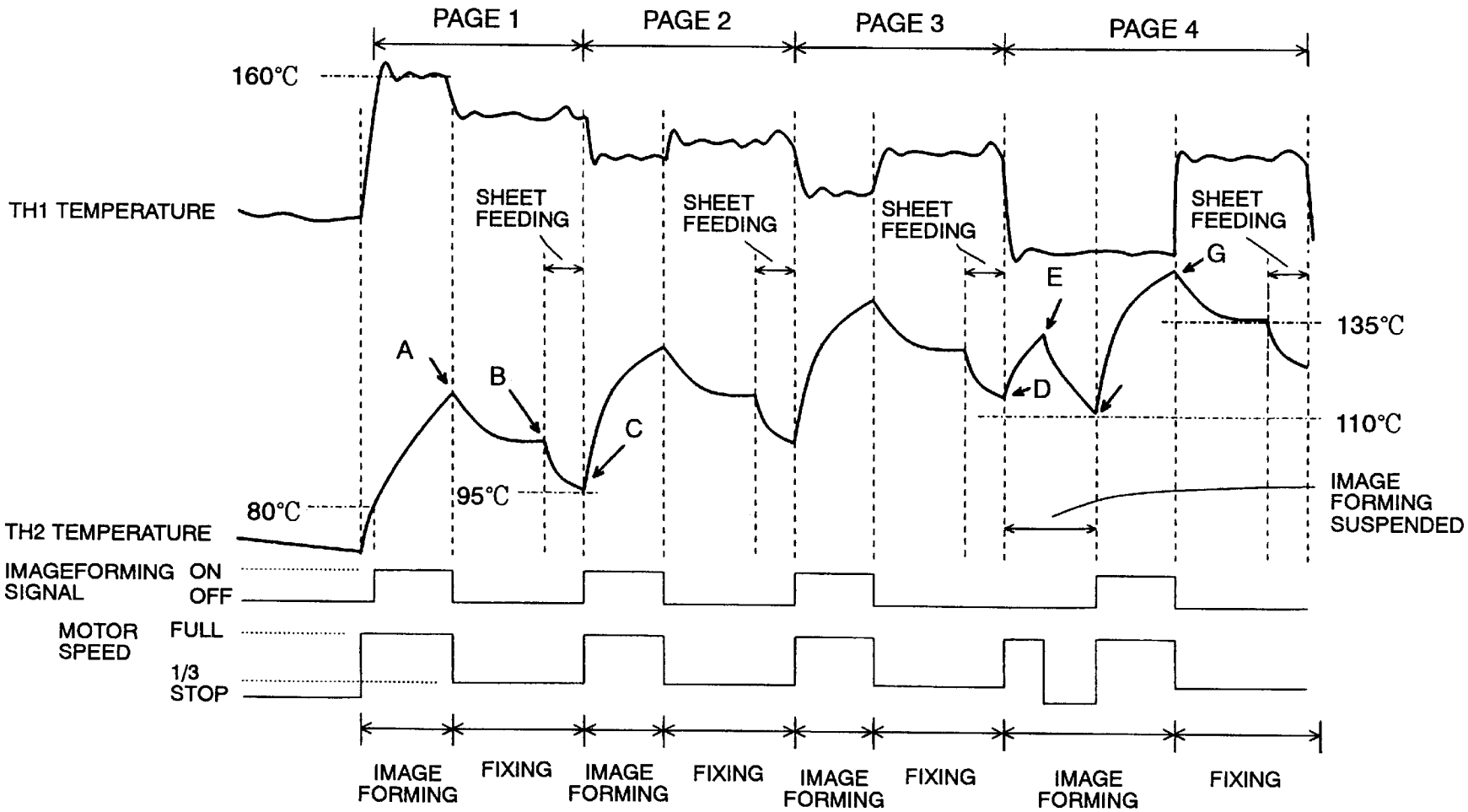
FIG. 4 is a timing chart of temperature control and image forming control of the fixing apparatus.

Next, let us describe the temperature control and the image forming control of the image forming system of the belt type fixing apparatus, referring to a timing chart as shown in FIG. 4. The control process for the image forming on the continuously fed sheet will be described.

The printer initiates its, action when it receives a print instruction from the computer, etc. This initiates the operation of the image forming system including the transfer route and rotation of the drive roller 31 of the fixing apparatus, and the lamp 32 is activated to increase its temperature. At this time, the motor is running at full speed. The heat generated by the lamp 32 during the image formation is controlled based on the temperature detected by the heat roller temperature sensor TH1 to maintain the temperature of the heat roller 33 approximately constant. What is meant by "during the image formation" in the above is a period from the feed of the sheet 10 to the image formation on the sheet 10, or to the step immediately before the sheet 10 enters the fixing apparatus.

The target temperature of the heat roller 33 is set based on the temperature detected by the fixing belt temperature sensor TH2 disposed on the pressure roller 35. Since the temperature during the image formation for the first page is the result of the temperature increase from the standby condition, it is set to a relatively high temperature so that the temperature of the nip area 38 settles down to a suitable fixing temperature when the image formation is completed.

The suitable fixing temperature for this embodiment is 95–135° C., and the temperature detected by the heat roller temperature sensor TH1 is about 160° C.

The temperature detected by the fixing belt temperature sensor TH2 is monitored while the temperature is under control during the image formation, and the signal for image formation is turned on when the predetermined temperature (80° C.) is reached. With this image forming signal, the feed of the sheet 10 is initiated and an unfixed toner image is formed on the sheet.

After the image formation is completed, the temperature control for the fixing operation begins to maintain the suitable temperature for the fixing operation. More specifically, the target temperature of the heat roller 33 during the fixing operation is set based on the temperature detected by the fixing belt temperature sensor TH2 disposed on the pressure roller 35 when the speed of the sheet transport system switches to that of the fixing operation as the image forming process is completed, i.e., the timing "A" when the motor speed is reduced to ⅓. The heat generated by the lamp 32 is controlled so that the temperature detected by the heat roller temperature sensor TH1 meets this target temperature. When a predetermined time has passed after the trailing edge of the sheet 10 is detected by the sensor S1 placed immediately before the image formation system in the sheet transfer route, it is judged that the image formation is completed and the motor speed is reduced.

Although the temperature control is shifted from the image forming mode to the fixing mode triggered by the motor speed change in this embodiment, the invention is not limited to it. It can be shifted to the temperature control mode for the image fixing basically when the sheet 10 enters the nip area 38. For example, it is possible to shift the temperature control to the fixing mode based on a timer's timing assuming that the sheet 10 arrives at the nip area a certain time after the detection of the sheet 10 by the sensor S1. Also, if the printer is large and has a place to hold the sheet 10 on the transport route between the image forming system and the fixing apparatus, a sensor can be provided in front of the fixing apparatus to detect the sheet 10 for shifting the temperature control to the fixing mode when the sensor detects the sheet 10.

When the sheet 10 arrives at the nip area 38 while the temperature control is in the fixing mode, the temperature detected by the fixing belt temperature sensor TH2 drops sharply from point "B" to "C" as shown in the graph as the sheet 10 takes away the heat from the nip area 38. Therefore, the temperature of the nip area 38 is controlled so as not to go below the temperature suitable for the fixing operation due to the passage of the sheet 10 through it. More specifically, the heat generated by the lamp 32 is controlled based on the temperature detected by the fixing belt temperature sensor TH2 at point "A", i.e., when the temperature control shifts from the image forming mode to the fixing operation mode, in such a way as to maintain the temperature detected by the heat roller temperature sensor TH1 constant during the fixing operation.

When the fixing operation is completed, the motor rotates at full speed and the temperature control shifts back to the image forming mode. The target temperature of the heat roller 33 is set based on the temperature detected by the fixing belt temperature sensor TH2 at point "C", or immediately after the sheet 10 passes the nip area 38. Whether the sheet 10 has passed or not is judged based on the detection of the trailing edge of the sheet 10 by the sheet sensor S2 provided near the discharge port of the nip area 38 of the fixing apparatus.

Since the detected temperature of the fixing belt at this time is that of the second page in case of a continuous printing mode, it will be higher that that of the printing process for the first page. Consequently, the target temperature for the heat roller 33 during the image forming process of the second page is set up in such a way that the temperature of the fixing belt at the nip area 38 would not be too high, and the heat generated by the lamp 32 is controlled to maintain the temperature detected by the heat roller temperature sensor TH1 approximately constant.

After that, when the image formation is completed and the motor speed has reached the ⅓ speed, the temperature control is shifted from the image forming mode to the fixing mode to fix the unfixed toner image.

Thereafter, until the continuous printing is completed, the temperature control for the image forming mode and the temperature control for the fixing mode are executed reciprocally. If the temperature detected by the fixing belt temperature sensor TH2 exceeds the predetermined temperature when the sheet 10 has just passed through the nip area 38, all the printing operations, including those of the image forming operations, are suspended. This condition is shown as point "D" immediately after the passing of the sheet in the printing process of the fourth page shown in FIG. 4. In this case, the predetermined temperature is set at 110° C.

In this case, the motor is run at full speed to drive the transportation system until the sheet 10 that has finished fixing is discharged to the paper discharge tray 26. The motor stops when the sensor S3 placed just before the paper discharge tray 26 detects the trailing edge of the sheet 10. The image forming signal is off during this period. On the other hand, the lamp 32 is either turned off or switched to a setting for a very low temperature when the temperature detected by the fixing belt temperature sensor TH2 exceeds the predetermined temperature. Until the paper discharge operation is completed, the motor rotates at full speed and the heat transfer is increased, the temperature detected by the fixing belt temperature sensor TH2 rises temporarily as shown between points "D" and "E," but drops after the motor stops rotating.

When the temperature detected by the fixing belt temperature sensor TH2 drops to the predetermined temperature, the image forming signal is turned on in order to start the image forming operation, the motor starts to rotate and the image forming operation begins. After that, when the image forming operation is completed and the motor rotating speed reduces to the ⅓ speed, the temperature control is shifted to the image forming mode to the fixing mode. The temperature during the fixing operation is set similarly based on the temperature detected by the fixing belt temperature sensor TH2 at point "G", i.e., when the motor speed reaches the ⅓ speed.

As described above, the target temperature of the heat roller 33 can be easily set, only based on the temperature detected by the fixing belt temperature sensor TH2 disposed on the pressure roller 35, irrespective of the temperature detected by the heat roller temperature sensor TH1. For example, the temperature of the heat roller 33 can be controlled to match the target temperature by adjusting the heat generated by the lamp 32 through on/off control or duty proportion control of the lamp 32. Furthermore, the temperature of the heat roller 33 can be controlled to match the target temperature by adjusting the heat generated by the lamp 32 through on/off control or duty proportion control of the lamp 32 based on a predetermined value that corresponds to the output of the fixing belt temperature sensor TH2.

Moreover, when it is determined that the temperature of the nip area 38 exceeded the temperature suitable for fixing based on the temperature detected by the fixing belt temperature sensor TH2 disposed on the pressure roller 35, the image forming operation is stopped and the transport operation of the sheet 10 is interrupted. When the temperature of the nip area 38 falls, the image forming operation is restarted, followed by the fixing operation. Thus, image failures due to excessively high temperatures of the fixing apparatus can be avoided.

Moreover, in this embodiment, all the printing operations, including those of the image forming system, will be suspended, if the temperature detected by the fixing belt temperature sensor TH2 exceeds the predetermined temperature. This is necessary because the transport route between the image forming system and the fixing apparatus is designed short with no place to hold the sheet after the image formation to make the printer more compact. In case of a larger printer or copying machine in which the transport route is long enough to accommodate a place to hold a sheet, it is possible to hold the sheet immediately before the fixing apparatus after image formation to wait until the nip area 38 cools down.

The fixing apparatus of this embodiment is constituted as shown in FIG. 2 in such a way that only one of the rollers that support the fixing belt, or only the drive roller is in contact with the pressure roller under pressure. However, the application of the invention is not limited to such a constitution, but rather can be applied suitably to any fixing belt type fixing apparatus.

Figure 5:
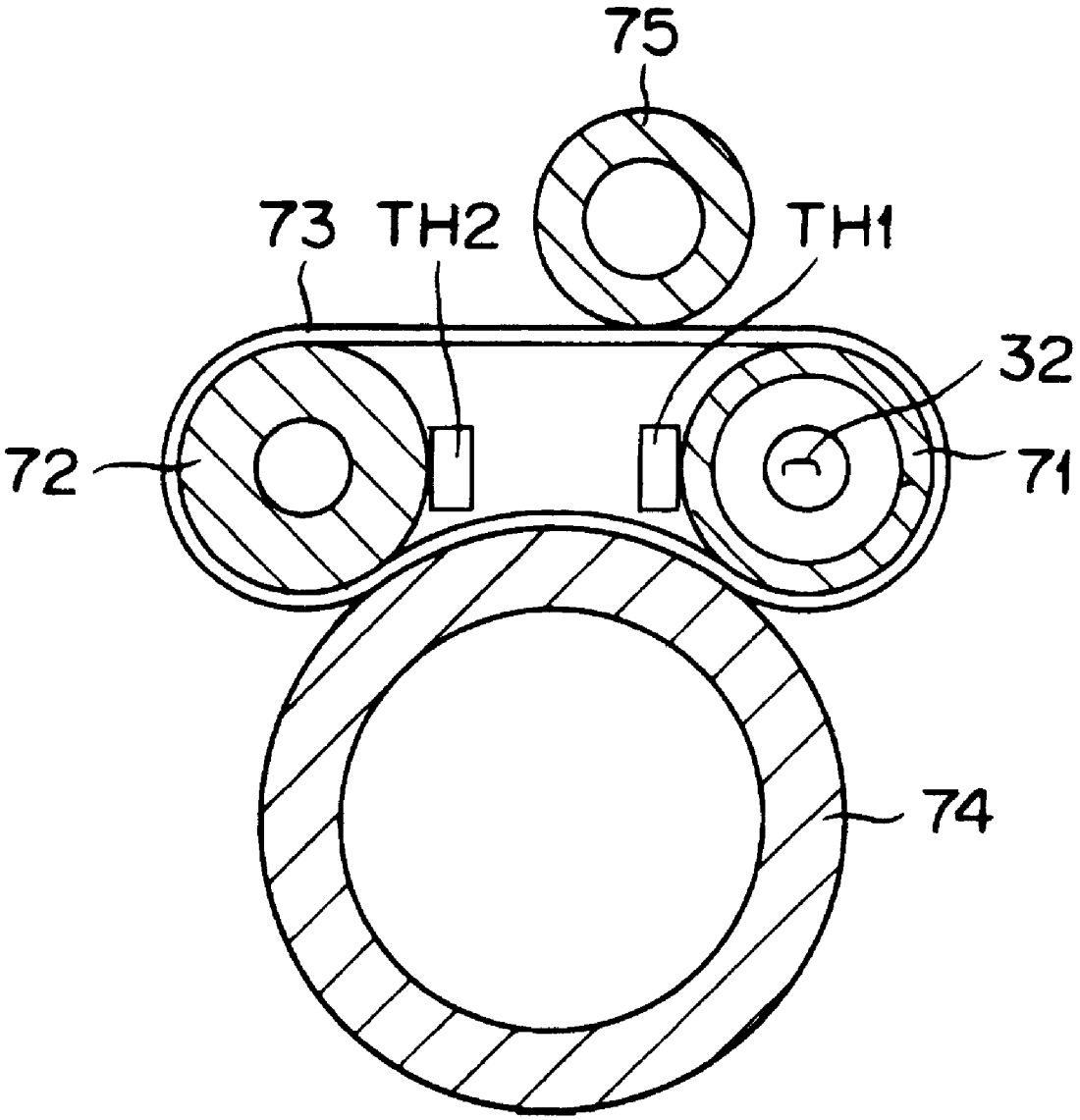
FIG. 5 is a cross section of another fixing apparatus applicable.

For example, it can be applied to a relatively large fixing apparatus, such as the one shown in FIG. 5, comprising a heat roller 71 containing a halogen heater lamp 32 inside, a drive roller 72 without a heating source, a fixing belt 73 supported by the two rollers, and a relatively large pressure roller 74 that is in contact with both rollers 71 and 72 via the fixing belt 73. This fixing apparatus further comprises a heat roller temperature sensor TH1 that is in contact with the heat roller 71 and a fixing belt temperature sensor TH2 that is in contact with the drive roller 72.

The fixing belt temperature sensor TH2 disposed on the drive roller 72 may be arranged to contact other rollers without heating source such as the pressure roller 74, an oil coating roller, and a cleaning roller. A tension roller indicated with a reference sign 75 in the drawing can be consisted of an oil coating roller or a cleaning roller. The temperature control and operation control of the image forming system for this fixing apparatus are accomplished, similar to the previously described fixing system, using the target temperature of the heat roller 71 set up based on the temperature detected by the fixing belt temperature sensor TH2 disposed on the drive roller 72.

Embodiment 2

Figure 6:
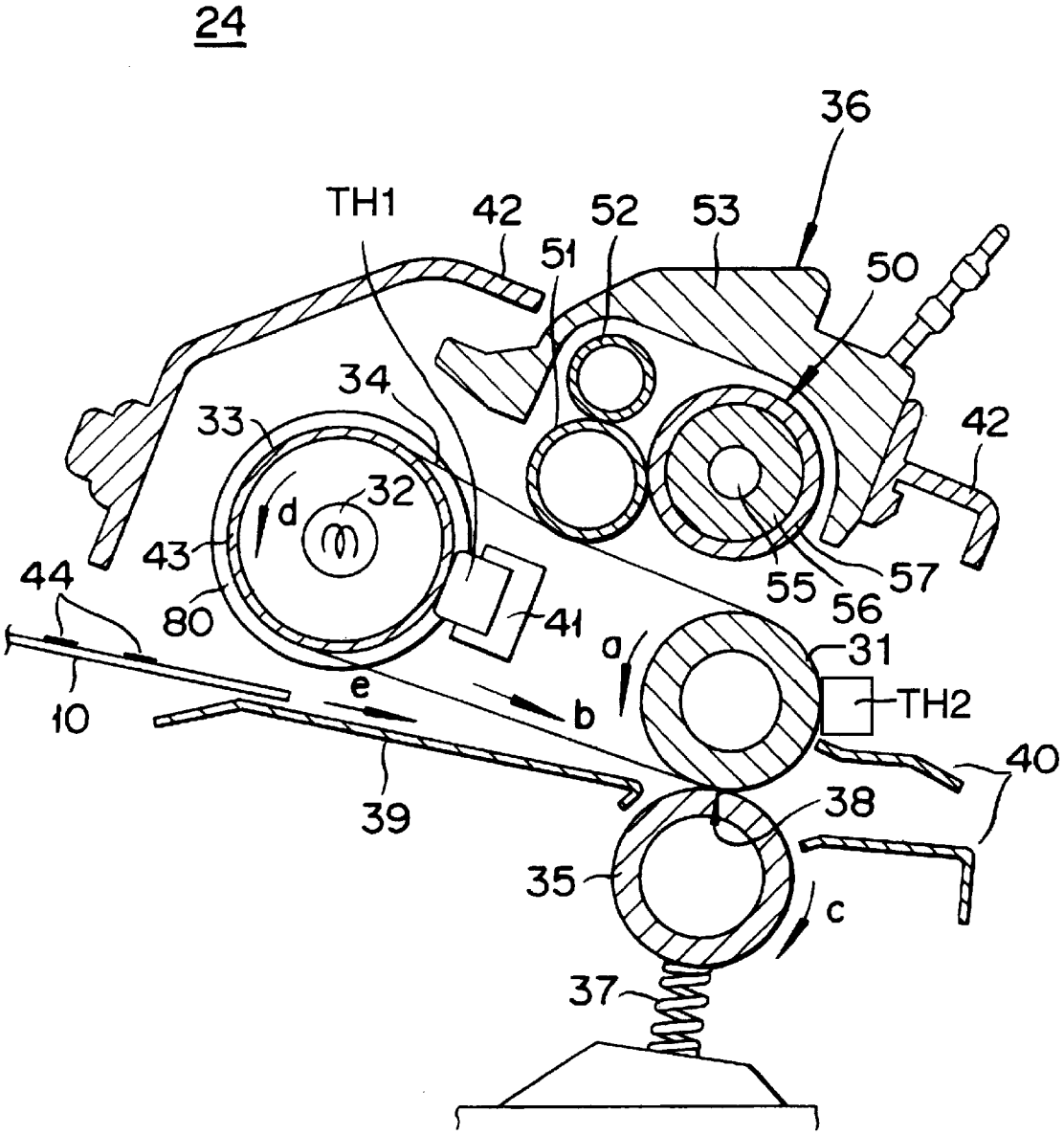
FIG. 6 is a cross section of a fixing apparatus of a second embodiment according to the present invention.

The fixing belt temperature sensor TH2 of the fixing apparatus in this embodiment is placed on the downstream side of the nip area 38 relative to the rotating/moving direction of the fixing belt 34, as shown in FIG. 6, and detects the temperature of the fixing belt 34 directly.

In this embodiment, where the temperature sensor TH2 is directly abutting against the outer surface of the fixing belt, there is a concern for oil streaks. However, the oil transfer roller 51 is placed further on the downstream side of the fixing belt temperature sensor TH2, which is placed on the downstream side of the nip area 38. Therefore, even if the oil coated on the outside surface of the fixing belt is disturbed by the fixing belt temperature sensor TH2, the outside surface of the fixing belt 34 will be coated again with the oil supplied by the oil transfer roller 51 located downstream. Thus, by the time the fixing belt 34 passes the nip area 38, a good oil coating condition will be maintained. And the abutment of the fixing belt temperature sensor TH2 against the outer surface of the fixing belt does not affect the fixation of the unfixed toner image. The descriptions of the mechanical and control constitutions as well as the functions as the fixing apparatus, which are similar to those of the embodiment 1, will not be repeated here to avoid redundancy.

Figure 7:
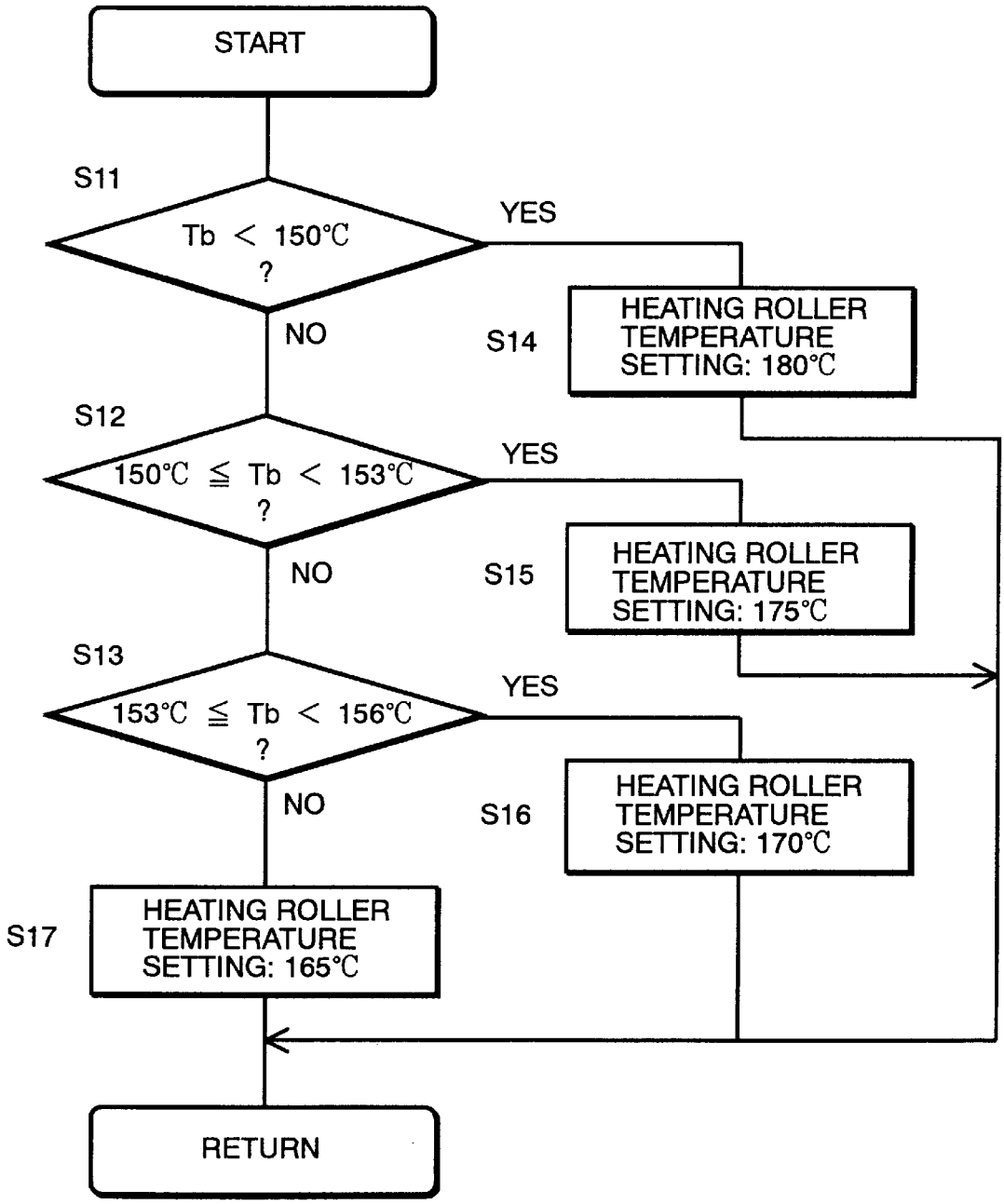
FIG. 7 is a flow chart of temperature setting procedures of the fixing apparatus.

The temperature control operation for the fixing belt will be described in the following referring to the flow chart of FIG. 7 that shows the procedure of the temperature control. Incidentally, the flow chart shows only the portion of the temperature control in the main routine that is responsible for controlling the timing of feeding the sheet to the fixing apparatus. And the sheet feed timing control for the entire printing at the fixing apparatus is the same as in the embodiment 1 so that it is not repeated here.

First, the temperature Tb detected by the fixing belt temperature sensor TH2 and the first reference temperature is compared (S11). The first reference temperature is set to 150° C. in this case. The first reference temperature is the lower limit of the fixing belt temperature required to keep the nip area temperature to a temperature suitable for fixing during the fixing operation. If the temperature Tb detected by the fixing belt temperature sensor TH2 is judged to be lower than 150° C. at Step 11, the target temperature of the heat roller 33 will be set at 180° C. to raise the fixing belt temperature (S14). Then, the control means, or the CPU 61 shown in FIG. 3 outputs a temperature control signal to control the lamp 32 to maintain the temperature detected by the heat roller temperature sensor TH1 at 180° C.

On the other hand, if the temperature Tb detected by the fixing belt temperature sensor TH2 is judged to exceed 150° C. as the first reference temperature at Step S11, the temperature Tb detected by the fixing belt temperature sensor TH2 is checked whether it is between the first and second reference temperatures (S12). The second reference temperature is set at 153° C. in advance in this case. The second reference temperature is also the middle value of the temperature tolerance band of the fixing belt during the fixing operation.

If the temperature Tb detected by the fixing belt temperature sensor TH2 is judged to be within the range between the first and second reference temperatures at Step S12, the target temperature of the heat roller 33 will be set at 175° C. (S15). Then, the CPU61 outputs a temperature control signal to control the lamp 32 to maintain the temperature detected by the heat roller temperature sensor TH1 to be 175° C.

If the temperature Tb detected by the fixing belt temperature sensor TH2 is judged to be not within the range between the first and second reference temperatures at Step S12, a judgment is made whether the temperature Tb detected by the fixing belt temperature sensor TH2 is within the range between the second and third reference temperatures (Step S13). The third reference temperature is set at 156° C. in advance in this case. The third reference temperature is the upper limit of the fixing belt temperature suitable for the fixing operation.

If the temperature Tb detected by the fixing belt temperature sensor TH2 is judged to be within the range between the second and third reference temperatures at Step S13, the target temperature of the heat roller 33 will be set at 170° C. (S16). Then, the CPU61 outputs a temperature control signal to control the lamp 32 to maintain the temperature detected by the heat roller temperature sensor TH1 to be 170° C.

If the temperature Tb detected by the fixing belt temperature sensor TH2 is judged to be not within the range between the second and third reference temperatures, exceeding the third reference temperature of 156° C. at Step S13, the target temperature of the heat roller 33 will be set at 165° C. (S17). Then, the CPU61 outputs a temperature control signal to control the lamp 32 to maintain the temperature detected by the heat roller temperature sensor TH1 to be 165° C.

Since the target temperature of the heat roller is set based on the fixing belt temperature detected on the downstream side of the nip area, i.e., the downstream side of the fixing area of the fixing belt in this embodiment, thermal energy suitable for fixing can be supplied to the recording sheet holding unfixed images, irrespective of the sheet feeding mode, waiting time, and ambient temperature.

The fixing belt temperature has to be detected in the temperature setting process at a time when it has reached a sufficiently high temperature after the fixing operation has been started. More specifically, the timing for detecting the fixing belt temperature is when the belt has started from the standby condition, heating of the heat roller 33 has started, and the fixing belt 34 has made at least one revolution. Also, since the fixing belt temperature falls when a new page is fed, the fixing belt temperature should be detected, for the second page or the following pages in the continuous feeding mode, when the belt has made at least one revolution after the previous page has passed.

Embodiment 3

Figure 8:
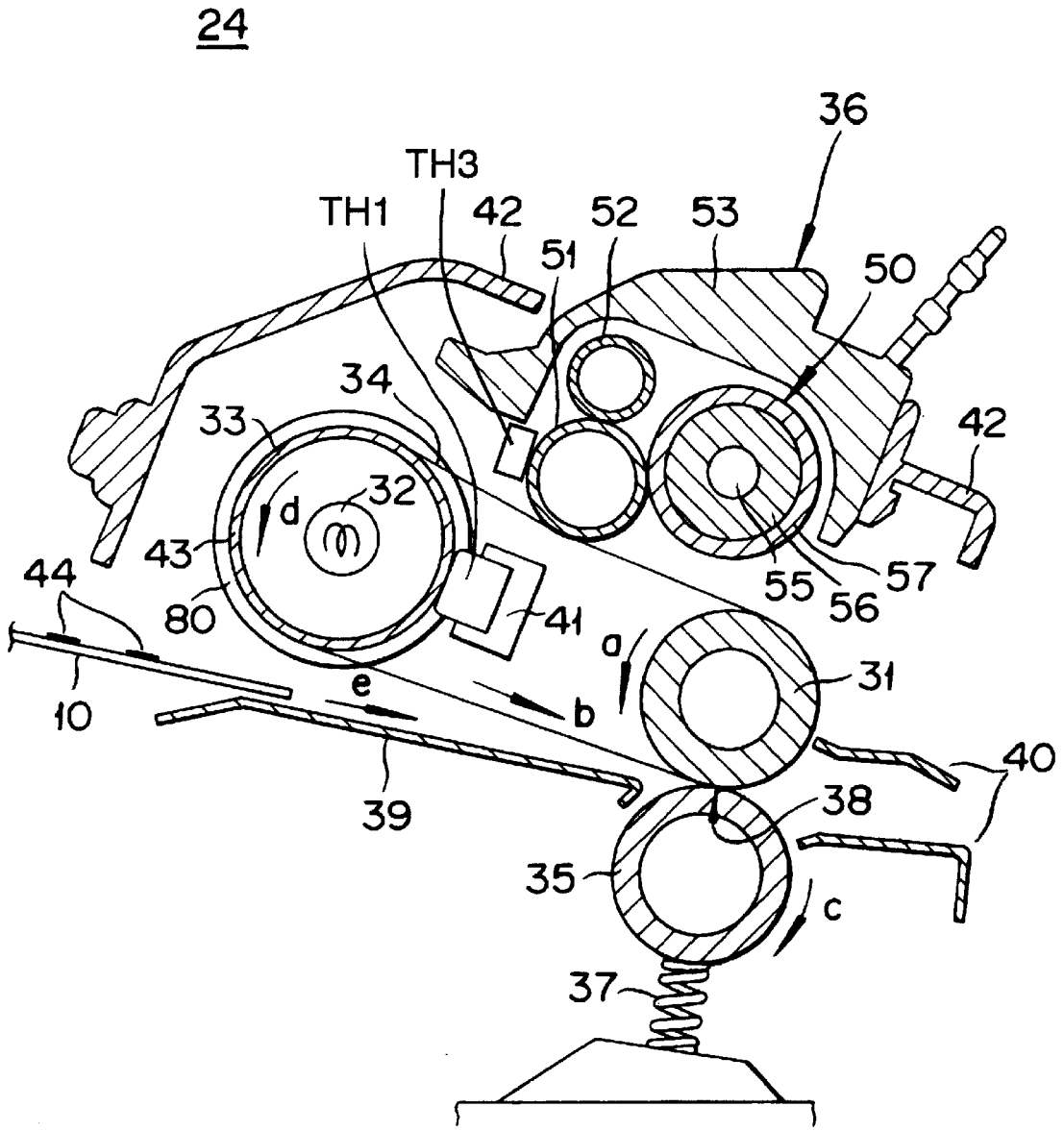
FIG. 8 is a cross section of a fixing apparatus of a third embodiment according to the present invention.

As shown in FIG. 8, this embodiment includes a temperature sensor TH3 placed on the downstream side of the rotating/moving direction of the fixing belt 34 for detecting the temperature of the oil transfer roller 51 that contacts the fixing belt under pressure and functions also as a tension roller. And the fixing belt temperature is indirectly detected based on the tension roller temperature measured by the temperature sensor TH3. The descriptions of the mechanical and control constitutions as well as the functions as the fixing apparatus, which are similar to those of the embodiment 1, will not be repeated here to avoid redundancy. Although the control constitution is the same as the one shown in FIG. 3, the signal of the transfer roller temperature sensor TH3 is entered into the CPU61 instead of the fixing belt temperature sensor TH2. Moreover, since the oil transfer roller 51 functions also as a tension roller, the transfer roller temperature sensor TH3 is also the tension roller temperature sensor.

Figure 9:
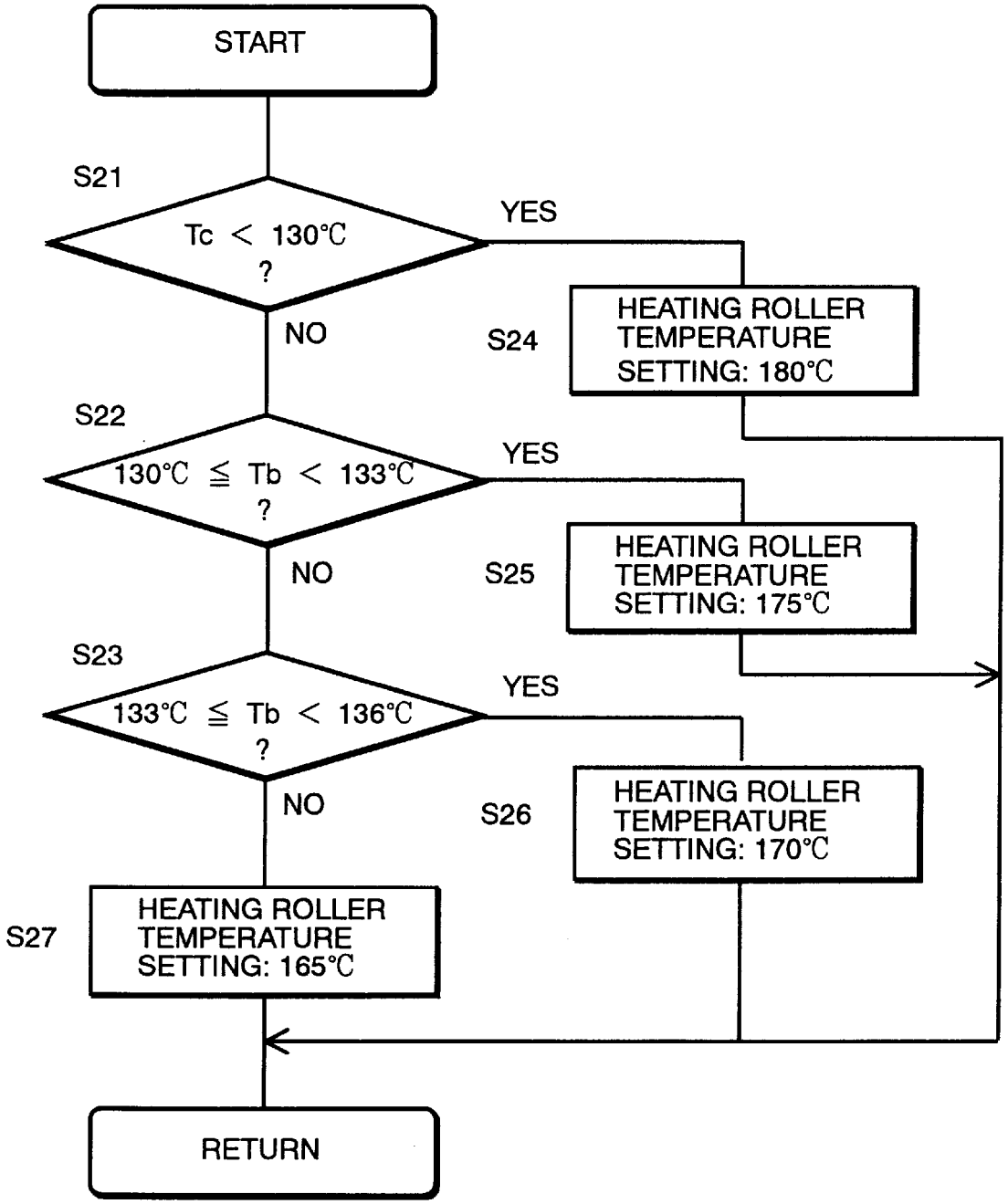
FIG. 9 is a flow chart of temperature setting procedures of the fixing apparatus.

The temperature control operation for the fixing belt will be described in the following referring to the flow chart of FIG. 9 that shows the procedure of the temperature control. Same as in the case of the embodiment 2, the flow chart shows only the portion of the temperature control in the main routine that is responsible for controlling the timing of feeding the sheet to the fixing apparatus. The sheet feed timing control for the entire printing at the fixing apparatus is the same as in the embodiment 1 so that it is not repeated here.

First, the temperature Tc detected by the transfer roller temperature sensor TH3 and the first reference temperature is compared (S21). The first reference temperature is set to 130° C. in this case. The first reference temperature is the lower limit of the oil transfer roller 51's temperature required to keep the nip area 38's temperature to a temperature suitable for fixing during the fixing operation. The relation between the fixing belt temperature and the oil transfer roller temperature will be described later.

If the temperature Tc detected by the transfer roller temperature sensor TH3 is judged to be lower than 130° C. at Step S21, the target temperature of the heat roller 33 will be set at 180° C. to raise the fixing belt temperature (S24). Then, the control means, or the CPU 61 shown in FIG. 3 outputs a temperature control signal to control the lamp 32 to maintain the temperature detected by the heat roller temperature sensor TH1 at 180° C.

On the other hand, if the temperature Tc detected by the transfer roller temperature sensor TH3 is judged to exceed 130° C. as the first reference temperature at Step S21, the temperature Tc detected by the transfer roller temperature sensor TH3 is judged whether it is within the range between the first and second reference temperatures (S22). The second reference temperature is set at 133° C. in advance in this case. The second reference temperature is also the middle value of the temperature tolerance band of the oil transfer roller temperature during the fixing operation.

If the temperature Tc detected by the transfer roller temperature sensor TH3 is judged to be within the range between the first and second reference temperatures at Step S22, the target temperature of the heat roller 33 will be set at 175° C. (S25). Then, the CPU61 outputs a temperature control signal to control the lamp 32 to maintain the temperature detected by the heat roller temperature sensor TH1 to be 175° C.

If the temperature Tc detected by the transfer roller temperature sensor TH3 is judged to be not within the range between the first and second reference temperatures at Step S22, a judgment is made whether the temperature Tc detected by the transfer roller temperature sensor TH3 is within the range between the second and third reference temperatures (Step S23). The third reference temperature is set at 136° C. in advance in this case. The third reference temperature is the upper limit of the oil transfer roller temperature suitable for the fixing operation.

If the temperature Tc detected by the transfer roller temperature sensor TH3 is judged to be within the range between the second and third reference temperatures at Step S23, the target temperature of the heat roller 33 will be set at 170° C. (S26). Then, the CPU61 outputs a temperature control signal to control the lamp 32 to maintain the temperature detected by the heat roller temperature sensor TH1 to be 170° C.

If the temperature Tc detected by the transfer roller temperature sensor TH3 is judged to be not within the range between the second and third reference temperatures at Step 23, exceeding the third reference temperature of 136° C., the target temperature of the heat roller 33 will be set at 165° C. (S27). Then, the CPU61 outputs a temperature control signal to control the lamp 32 to maintain the temperature detected by the heat roller temperature sensor TH1 to be 165° C.

Next, let us describe the relation between the fixing belt temperature and the oil transfer roller temperature.

Figure 10:
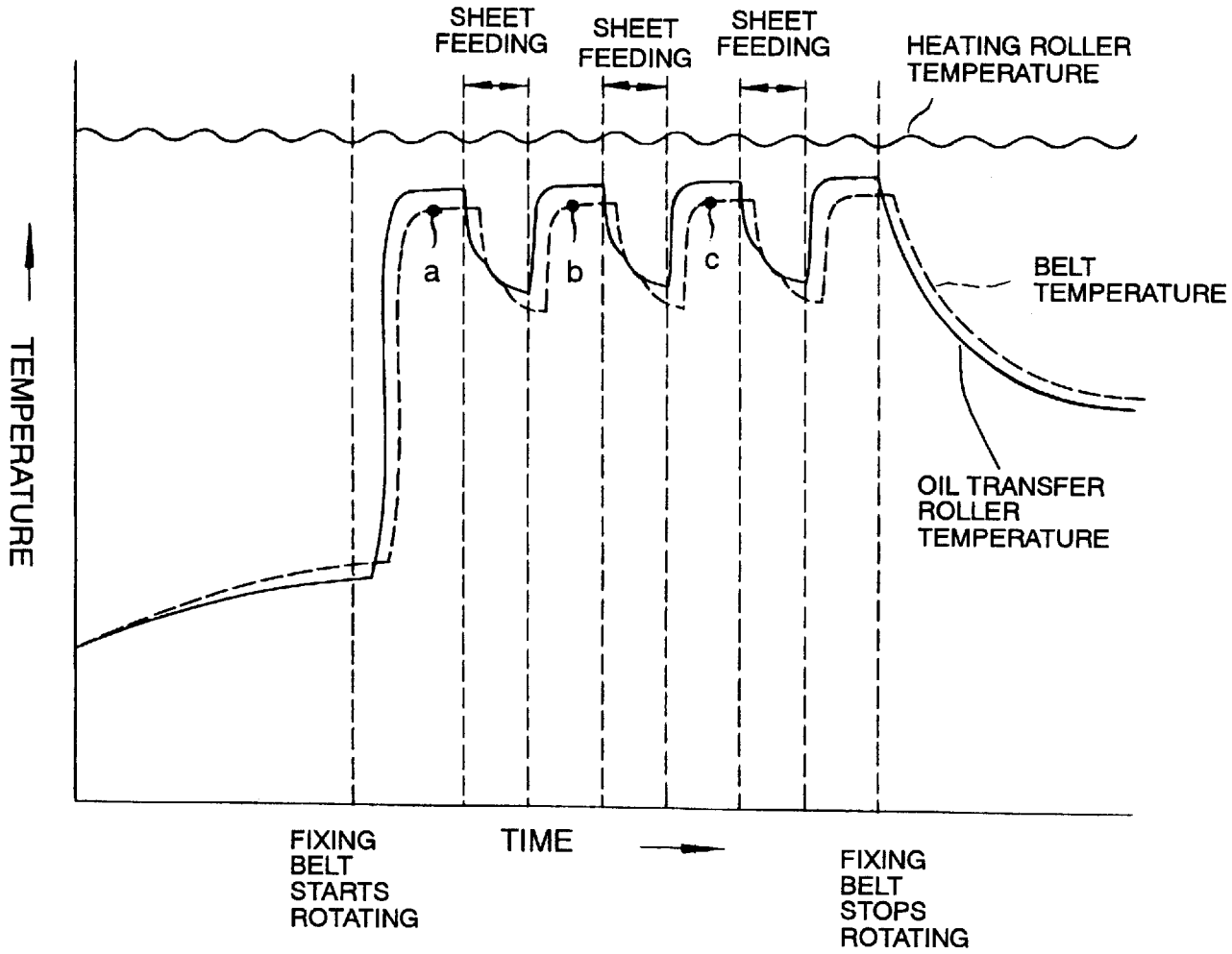
FIG. 10 is a timing chart for describing heat roller temperature, fixing belt temperature and oil transfer roller temperature.

FIG. 10 shows the heat roller temperature, the fixing belt temperature and the oil transfer roller temperature. Here, it is assumed that the heat roller temperature is approximately constant for the benefit of understanding the relation between the fixing belt temperature and the oil transfer roller temperature. However, as explained in the description of the embodiment 1, if the drive source that rotate/drives the fixing belt is the same as the drive source of the transport route including the image forming system as shown in FIG. 4, the heat roller temperature changes in the actual operation with the change of speed of the drive source such as the motor during the image forming, fixing and sheet transporting.

As can be seen from FIG. 10, the temperature of the oil transfer roller is slightly lower than the fixing belt temperature, and its rise and fall are slightly lagging. The reason that the oil transfer roller temperature is slightly lower than the fixing belt temperature is that the oil transfer roller 51 is located about half of the fixing belt on the downstream side of the nip area 38 as shown in FIG. 8, and the temperature of the fixing belt falls while it travels from the nip area 38 to the oil transfer roller 51. The reason that its temperature's rise and fall are lagging is that the oil existing on the surface of the oil transfer roller 51 delays the heat transfer from the fixing belt 34. This tendency also appears in the actual fixing operation shown in FIG. 4.

Due to these phenomena, it is necessary to detect the temperature of the oil transfer roller 51 at a timing slightly after the fixing belt temperature has risen sufficiently after the start up of the fixing operation. More specifically, the temperature of the oil transfer roller 51 is detected at point "a" of FIG. 10, or when the fixing belt has made at least one revolution after heating of the heat roller and rotation of the fixing belt have started in order to shift from the standby condition to the fixing operation. Also, since the fixing belt temperature falls when a new page is fed, the temperature of the oil transfer roller 51 should be detected for the second page or the following pages in the continuous feeding mode, at point "b" or "c" of FIG. 10, or when the belt has made at least one revolution after the previous page has passed.

As described above, thermal energy suitable for fixing can be supplied to the recording sheet holding unfixed images, irrespective of the sheet feeding mode, waiting time, and ambient temperature, as the target temperature of the heat roller is set based on the temperature detected on the oil transfer roller located on the downstream side of the nip area. Moreover, since the temperature is measured on the oil transfer roller rather than detecting the temperature of the fixing belt by contacting it with the temperature sensor directly, the load on the fixing belt is smaller thus prolonging the life of the fixing belt. For example, under the same condition, the fixing belt lasts about 50% longer in this case compared to having the temperature sensor on the fixing belt.

Moreover, the target temperature of the heat roller 33 is set directly based on the temperature detected by the transfer roller temperature sensor TH3. It is also possible to estimate the fixing belt temperature from the temperature detected by the transfer roller temperature sensor TH3, and determine the target temperature for the heat roller 33 based on the estimated temperature. The procedure for determining the target temperature for the heat roller 33 in such a case is identical to that of the embodiment 2 shown in the flow chart of FIG. 7, except that the temperature Tb detected by the fixing belt temperature sensor TH2 has to be replaced by the estimate value of the fixing belt temperature.

In conclusion, if the target temperature of a roller is set based on the temperature measured by the temperature sensor for detecting a fixing belt temperature, the control of the fixing temperature is simpler because it doesn't need any information from the temperature sensor that detects a roller temperature.

If a heating source is contained in the roller, the roller temperature sensor can detect the roller temperature without being directly affected by the heat source.

In a continuous printing process, if the target temperature of a roller containing a heating source is to be set based on the temperature detected by a fixing belt temperature sensor immediately behind a point where the trailing edge of a recording medium leaves the fixing area, the fixing area temperature can be detected with a high accuracy thus enabling a temperature setting suitable for fixing the next recording medium.

Also, if the target temperature of a roller containing a heating source is to be set based on the temperature detected by a fixing belt temperature sensor at a predetermined time prior to a timing when the leading edge of a recording medium enters the fixing area, it is possible to determine whether the fixing area temperature is suitable for fixing or not before the leading edge of the recording medium enters the fixing area. Therefore, if the fixing area temperature is unsuitable for fixing, it can be adjusted to a temperature suitable for fixing by controlling the heating source.

If the fixing belt temperature is detected indirectly, the fixing belt temperature can be detected without causing any oil streak on the fixing belt surface.

If the target temperature of a roller is to be set and the image forming timing is to be controlled based on the temperature detected by a fixing belt temperature sensor, the fixing temperature can be relatively easily controlled since it doesn't require any information from a roller temperature sensor, and if the roller temperature is unsuitable for fixing, the image forming operation can be suspended until it reaches a temperature suitable for fixing.

Also, if it is so arranged that an image forming operation is suspended when the fixing belt temperature detected immediately behind a point where the trailing edge of the recording medium leaves the fixing area exceeds a predetermined temperature, the image forming operation can be restarted after the fixing area temperature falls to a suitable temperature. Therefore, the effects of the heat accumulated in the fixing area can be eliminated in case of a continuous printing process.

If the fixing belt temperature is detected in the downstream side of the fixing area relative to the rotating/moving direction of the fixing belt, and the heating source is controlled based on this detected temperature, the heat supply condition at the fixing area can be detected as a temperature. Therefore, if the heating source is controlled based on this detected temperature, the heat supply can be relatively easily controlled to provide a stable fixing performance even if the ambient temperature, sheet feeding mode or holding time changes.

If a temperature sensor is provided to detect the temperature of at least one of the rollers that support the fixing belt, the target temperature of the roller that is contacting the fixing belt is set based on the fixing belt temperature sensor provided on the down stream side of the fixing area, and the heating source is controlled so that the temperature detected by the roller temperature sensor reaches the target temperature, the temperature of the fixing belt can be controlled more securely, thus improving the fixing stability at the fixing area.

Also, if at least one of the rollers is equipped with a heating source, and the fixing belt temperature sensor is provided between the fixing area and the roller equipped with the heat source, any temperature drop due to sheet feeding can be detected before the fixing belt reaches the roller equipped with the heating source. Thus, the current temperature of the fixing area can be accurately detected. By controlling the heating source based on this detected temperature, accurate temperature control becomes possible, particularly considering the temperature change effect due to sheet feeding, thus enabling stable fixing performances.

If the fixing belt temperature is to be indirectly detected without having a temperature sensor contacting the belt, the contact load to the fixing belt can be reduced, thus prolonging the life of the fixing belt.

If a tension roller is provided on the downstream side of the fixing area relative to the rotating/moving direction of the fixing belt, and the fixing belt temperature is indirectly detected based on the tension roller temperature, the life of the fixing belt can be improved as the contact load to the fixing belt can be reduced.

If the tension roller functions also as an oil coating roller to coat the fixing belt with oil, the mechanical constitution can be simplified.

If a tension roller is provided that contacts the fixing belt on the downstream side of the fixing area relative to the rotating/moving direction of the fixing belt, and the heating source is controlled based on the temperature detected by the tension roller temperature sensor, the heat supply condition at the fixing area can be detected as a temperature without contacting the fixing belt, and also the heat supply can be controlled to provide a stable fixing performance even when the ambient temperature, sheet feeding mode, or holding time changes.

If a roller temperature sensor is provided to detect the temperature of at least one of the rollers that are supporting the fixing belt, and the heating source is controlled based on the temperature detected by the roller temperature sensor and the temperature detected by the tension roller temperature sensor, the fixing belt temperature can be more securely controlled and a more stable fixing performance can be provided at the fixing area.

It is obvious that this invention is not limited to the particular embodiments shown and described above but may be variously changed and modified without departing from the technical concept of this invention. Further, the entire disclosures of Japanese Patent Application Nos. 09-297170 filed on Oct. 29, 1997 and 10-270034 filed on Sep. 24, 1998, including the specification, claims, drawings and summary are incorporated herein by reference in their entirety.

What is claimed is:

1. A fixing apparatus comprising:

a plurality of rollers;

a belt supported by said rollers;

a heat source for heating said belt;

a roller temperature sensor that detects a temperature of one of said rollers;

a belt temperature sensor that detects a temperature of said belt; and a controller that determines a target temperature for said roller based on the temperature detected by said belt temperature sensor, and controls heat generated by said heating source based on the target temperature and the temperature detected by said roller temperature sensor.

2. A fixing apparatus according to claim 1, wherein said heating source is contained in at least one of said rollers and said roller temperature sensor detects the temperature of said roller equipped with said heating source.

3. A fixing apparatus according to claim 2, further comprising a transport mechanism that causes a recording medium to pass through a fixing area of said belt, said controller determining the target temperature of said roller based on the temperature detected by said belt temperature sensor immediately behind a point where a trailing edge of the recording medium leaves the fixing area.

4. A fixing apparatus according to claim 2, further comprising a transport mechanism that causes a recording medium to pass through a fixing area of said belt, said controller determining the target temperature of said roller based on the temperature detected by said belt temperature sensor a certain time before a leading edge of a recording medium reaches the fixing area.

5. A fixing apparatus according to claim 1, wherein said belt temperature sensor indirectly detects the temperature of said belt without contacting said belt.

6. An image forming apparatus comprising:

an image forming device for forming an unfixed image on a recording medium; and a fixing apparatus including a plurality of rollers, a belt supported by the rollers, a heat source for heating the belt, a roller temperature sensor that detects a temperature of one of said rollers, a belt temperature sensor that detects a temperature of the belt, a controller that determines a target temperature for the roller based on the temperature detected by the belt temperature sensor, controls heat generated by the heating source based on the target temperature and the temperature detected by the roller temperature sensor, and controls a timing for forming the unfixed image on the recording medium by means of said image forming device based on the temperature detected by the belt temperature sensor, and a transport mechanism for transporting, toward a fixing area of the belt, the recording medium holding the unfixed image formed by said image forming device.

7. An image forming apparatus according to claim 6, wherein said controller suspends image forming operations by said image forming device if the temperature detected by the belt temperature sensor exceeds a predetermined temperature.

8. A fixing apparatus comprising:

a plurality of rollers that rotate in a fixed direction;

a belt that is supported by said rollers and causes an unfixed image on a recording medium to be fixed at a fixing area;

a heating source that heats said belt;

a belt temperature sensor that detects a temperature of said belt on a downstream side of the fixing area relative to a rotating/moving direction of said belt; and a controller that controls said heating source based on the temperature detected by said belt temperature sensor.

9. A fixing apparatus according to claim 8, further comprising a roller temperature sensor to detect at least one of said rollers, said controller determining a target temperature of said roller contacting said belt and controlling said heating source so that the temperature detected by said roller temperature sensor reaches the target temperature.

10. A fixing apparatus according to claim 9, wherein said heating source is contained in at least one of said rollers, and said roller temperature sensor detects the temperature of said roller that is equipped with said heating source.

11. A fixing apparatus according to claim 8, wherein said heating source is contained in at least one of the rollers, and said belt temperature sensor detects the temperature at a point between the fixing area and said roller equipped with said heat source.

12. A fixing apparatus according to claim 8, wherein said belt temperature sensor indirectly detects the belt temperature without contacting said belt.

13. A fixing apparatus according to claim 12, further comprising a tension roller that contacts said belt on the downstream side of the fixing area, said belt temperature sensor indirectly detecting the belt temperature by means of measuring a temperature of said tension roller.

14. A fixing apparatus according to claim 13, wherein said tension roller is a roller for coating said belt with oil.

15. A fixing apparatus comprising:

a plurality of rollers that rotate in a fixed direction;

a belt that is supported by said rollers and causes an unfixed image on a recording medium to be fixed at a fixing area;

a heating source that heats said belt;

a tension roller that contacts said belt on a downstream side of the fixing area;

a tension roller temperature sensor that detects a temperature of said tension roller; and a controller that controls said heating source based on the temperature detected by said tension roller temperature sensor.

16. A fixing apparatus according to claim 15, further comprising a roller temperature sensor that detects a temperature of at least one of said rollers, said controller controlling said heating source based on the temperature detected by said tension roller sensor and the temperature detected by said roller temperature sensor.

* * * * *